US008494760B2

(12) United States Patent
Yoel et al.

(10) Patent No.: US 8,494,760 B2
(45) Date of Patent: Jul. 23, 2013

(54) AIRBORNE WIDEFIELD AIRSPACE IMAGING AND MONITORING

(75) Inventors: David William Yoel, Radnor, PA (US); John E. Littlefield, Delanco, NJ (US); Robert Duane Hill, Madison, AL (US)

(73) Assignee: American Aerospace Advisors, Inc., Radnor, PA (US)

( * ) Notice: Subject to any disclaimer, the term of this patent is extended or adjusted under 35 U.S.C. 154(b) by 48 days.

(21) Appl. No.: 12/967,718

(22) Filed: Dec. 14, 2010

(65) Prior Publication Data

US 2011/0184647 A1 Jul. 28, 2011

Related U.S. Application Data

(60) Provisional application No. 61/284,181, filed on Dec. 14, 2009.

(51) Int. Cl.
*G08G 5/04* (2006.01)
*G08G 5/00* (2006.01)

(52) U.S. Cl.
CPC ..... *G08G 5/0069* (2013.01); *G08G 5/0021* (2013.01); *G08G 5/0078* (2013.01)
USPC ..... 701/301

(58) Field of Classification Search
USPC ..... 701/301; 385/117, 120; 348/36, 348/359
IPC ..... G08G 5/04
See application file for complete search history.

(56) References Cited

U.S. PATENT DOCUMENTS 4,515,479 A * 5/1985 Pryor ..... 356/615
5,581,250 A * 12/1996 Khvilivitzky ..... 340/961
5,625,409 A 4/1997 Rosier et al.
6,205,275 B1 * 3/2001 Melville ..... 385/43
6,731,845 B1 * 5/2004 Gerdt ..... 385/116
6,804,607 B1 10/2004 Wood (Continued)

FOREIGN PATENT DOCUMENTS

EP 1296213 3/2003

OTHER PUBLICATIONS

Gandhi et al., "Detection of Obstacles in the Flight Path of an Aircraft", IEEE Transactions on Aerospace and Electronic Systems, vol. 39 No. 1, Jan. 2003, pp. 176-191.*

(Continued)

*Primary Examiner* — Mary Cheung
*Assistant Examiner* — Todd Melton
(74) *Attorney, Agent, or Firm* — Ober, Kaler, Grimes & Shriver; Royal W. Craig

(57) ABSTRACT

A Widefield Airspace Imaging and Navigation System to provide UASs with wide field airspace imaging and collision avoidance capabilities. An array of optical lenses are distributed throughout the aircraft to provide an unobstructed view in all directions around the aircraft. Each collection lens is coupled through an optical fiber to a camera that multiplexes the several images. A processing system is connected to the wide array imaging system, and it runs an image interpolation program for resolving a background image and for distinguishing objects that are not moving with the background. In addition, a navigation control program reads the image interpolation software and, upon detection of an approaching object, implements a rule-based avoidance maneuver by sending an appropriate signal to the existing UAS autopilot.

19 Claims, 5 Drawing Sheets

U.S. PATENT DOCUMENTS

| | | | | |
|---|---|---|---|---|
| 6,909,381 | B2 | 6/2005 | Kahn | |
| 7,061,401 | B2 | 6/2006 | Voos et al. | |
| 7,171,088 | B2 * | 1/2007 | Koyama et al. | 385/116 |
| 7,228,232 | B2 | 6/2007 | Bodin et al. | |
| 7,376,314 | B2 | 5/2008 | Reininger | |
| 2007/0093945 | A1 * | 4/2007 | Grzywna et al. | 701/23 |
| 2009/0015674 | A1 * | 1/2009 | Alley et al. | 348/144 |

OTHER PUBLICATIONS

F. Rafi et al., Autonomous Target Following by Unmanned Aerial Vehicles, SPIE Defense and Security Symposium, Orlando, Florida, 2006.

Simi Motion, see website: www.simi.com, last visited: Mar. 2, 2011.

* cited by examiner

3-D VIEW - SENSOR CONES

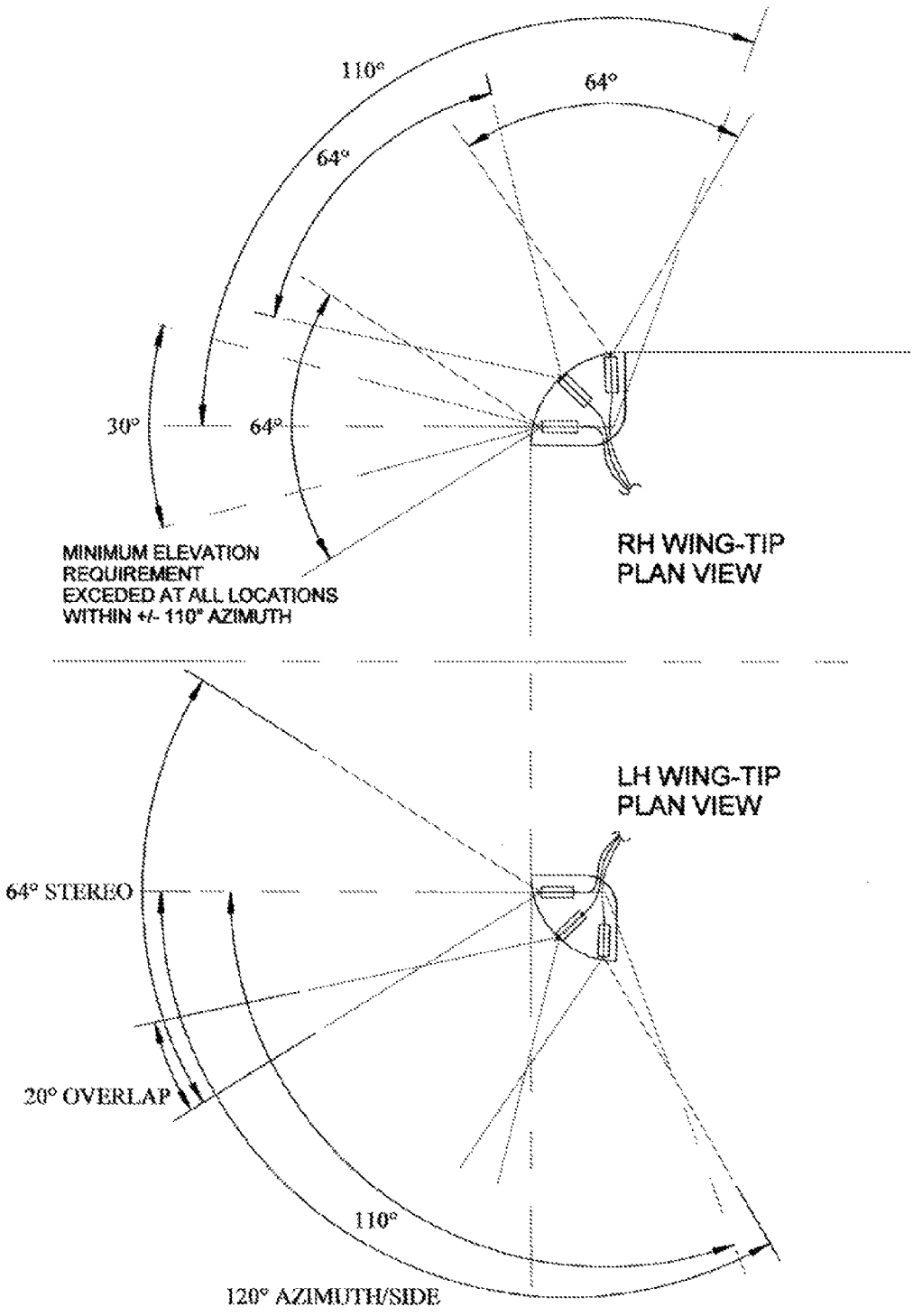
FIGURE 5 - ASTM F2411
MINIMUM VIEW ENVELOPE

AIRBORNE WIDEFIELD AIRSPACE IMAGING AND MONITORING

CROSS-REFERENCE TO RELATED APPLICATION(S)

The present application derives priority from U.S. provisional application Ser. No. 61/284,181 filed 14 Dec. 2009.

BACKGROUND OF THE INVENTION (1) Field of the Invention

The present invention relates to airborne imaging and navigation systems and, more particularly, to a wide field airborne imaging system capable of providing airspace imaging and sense and avoid capabilities over a large field of view at high resolution and range of detection using a single camera.

(2) Description of Prior Art

The Federal Aviation Administration promulgates both Visual flight Rules (VFR) and Instrument Flight Rules (IFR) for all manned aircraft. VFR regulations allow a pilot to operate an aircraft in clear weather conditions, and they incorporate the "see and avoid" principle, e.g. the pilot must be able to see outside the cockpit, to control the aircraft's attitude, navigate, and avoid obstacles and other aircraft. Pilots flying under VFR assume responsibility for their separation from other aircraft and are generally not assigned routes or altitudes by air traffic controllers, in contrast to IFR flights.

Unmanned Aircraft Systems (UASs) have no onboard pilot to perform the see and avoid function. In the past this was not a large issue because UASs were predominantly flown in foreign or military restricted airspace and war zones, and in these situations UASs do not typically come into conflict with manned civilian aircraft, nor are they required to comply with FAA Regulations. Currently, UASs can only fly domestically in our National Airspace System with special permission from the Federal Aviation Administration (FAA) given in the form of Certificates of Approval (COAs) issued to public entities for flight activities that have a public purpose, or alternatively under an Experimental Airworthiness Certificate issued to commercial entities for development, demonstration and training. Even then, only qualified ground observers or qualified personnel in manned chase aircraft are considered acceptable by the FAA to provide the See-And-Avoid (S&A) function.

Now, however, the demand for UASs is proliferating among the military, civil government, and private sectors due to growing awareness of their value and significant improvements in capabilities and performance. For example, over the last four years the U.S. Customs and Border Protection agency has been operating the Predator B Unmanned Aerial System (UAS) for its purposes. This has been done under the established rules in the National Airspace System.

The FAA has not yet established Federal Aviation Regulations (FARs) for UASs to fly routinely in the National Airspace System, and the potential for UASs is suppressed by an inability to comply with FAA rules. Not surprisingly, the industry has lobbied hard for clear and simple rules, and this has resulted in a recently introduced bill called the FAA Reauthorization Act of 2009, which calls for the FAA to provide within nine months after the date of enactment a comprehensive plan with detailed recommendations to safely integrate UASs into the NAS by 2013.

It is reasonable to assume that any new FAA rules will impose requirements similar to manned S&A rules, e.g., it is necessary to detect and avoid both cooperative aircraft (aircraft with radios and navigation aids such a transponders and ADS-B), and, importantly, non-cooperative aircraft such as parachutists, balloons, and manned aircraft without radios or navigation aids. Indeed, proposed FAR rules have been discussed. For example, the ASTM F-38 Committee has published a recommended standard for collision avoidance, (F2411-04 DSA Collision Avoidance) that proposes requiring a UAS operating in the NAS to be able to detect and avoid another airborne object within a range of + or −15 degrees in elevation and + or −110 degrees in azimuth and to be able to respond so that a collision is avoided by at least 500 ft. The ASTM standard may be incorporated in whole or in part into eventual FAA certification requirements. Complying with existing S&A rules would severely limit the range and conditions under which UASs can operate. The limits are in large part due to the lack of onboard S&A capabilities. Developing technical capabilities to comply with the proposed ASTM and other proposed rules is the subject of significant research but as yet has only resulted in proposed technical solutions that require substantial weight, volume and power to perform the task relative to the capacity of many UAS. Still, the publishing of UAS FARs will be a first major step toward routine operation of UASs in the National Air Space.

Since UASs do not have onboard pilot visual contact with the vehicle's surroundings, effective, onboard, autonomous S&A capabilities are necessary to facilitate operations of UASs in the NAS to avoid collisions with other aircraft or with terrain objects (e.g., buildings, power lines, trees and so on). In addition, UASs must have widefield detection capabilities (by radar, synthetic vision, etc.) in order to detect the range and altitude of nearby aircraft and perform "see and avoid" maneuvers.

Quite a number of alternative approaches to detecting other aircraft are being investigated at present including optical, acoustic, radar, etc. To the best of the present inventor's knowledge the prior art S&A systems are all very heavy when compared to the weight of the UAS, especially with regard to small UAS (sUAS). If the S&A detection device(s) are overweight, too large, or require too much power they can exceed the payload capacity of the UAS, or even exceed the weight of the entire UAS, frustrating its very purpose.

Against this backdrop, an effective S&A technology for UAS is critical to the future of the industry. What is needed is a system combining a wide field airborne imager capable of providing airspace imaging over a large field of view at high resolution and range of detection with low weight, volume and power using a single camera, and an automated trajectory-based control system to avoid collisions with other aircraft or with terrain objects (e.g., buildings, power lines, trees and so on).

There are a few enabling technologies that must be combined in order for such systems to be feasible, including: 1) wide field imaging; 2) digital image feature detection/motion analysis; 3) avoidance/alarm system.

With regard to prior art imaging, there are various types of imagers used in other contexts. For example, the F. Rafi et al. "Autonomous Target Following by Unmanned Aerial Vehicles", SPIE Defense and Security Symposium 2006, Orlando Fla. article describes an algorithm for the autonomous navigation of an unmanned aerial system (UAS) in which the aircraft visually tracks the target using a mounted camera. The camera is controlled by the algorithm according to the position and orientation of the aircraft and the position of the target. This application tracks a moving target in different directions, making turns, varying speed and even stopping, and does not rely on an ESRI Shapefile. A target-tracking camera is not suitable for UAS S&A which requires widefield detection capabilities.

U.S. Pat. No. 6,804,607 to Wood issued Oct. 12, 2004 shows a collision avoidance system using multiple sensors that establishes a 3D surveillance envelope surrounding the craft.

U.S. Pat. No. 7,061,401 to Voos et al. (Bodenseewerk Geratetechnik GmbH) issued Jun. 13, 2006 shows a method and apparatus for detecting a flight obstacle using four cameras for recording an overall image.

European Application No. EP 1296213 discloses a method of monitoring the airspace surrounding an unmanned aircraft by a number of cameras having different viewing angles, and the images are displayed to a ground pilot superimposed.

U.S. Pat. No. 6,909,381 to Kahn issued Jun. 21, 2005 shows an aircraft collision avoidance system utilizing video signals of the air space surrounding the aircraft for alerting pilots that an aircraft is too close.

U.S. Pat. No. 7,376,314 to Reininger (Spectral Imaging Laboratory) issued May 20, 2008 shows a fiber coupled artificial compound eye that channels light from hundreds of adjacent channels to a common point on the convex surface of a fiber optic imaging taper. The superposed light from all the channels form a curved, high intensity image onto a detector array. Multiple such systems are required to detect over a wide field of view.

U.S. Pat. No. 5,625,409 to Rosier et al. (Matra Cap Systems) issued Apr. 29, 1997 shows a high resolution long-range camera for an airborne platform using two imagers, a first detector and a second detector with a larger field of view, covering the field of the first detector and extending beyond it.

With regard to feature detection/motion analysis software, there are commercial programs for doing this to successive frames of video images. For example, Simi Motion at www.simi.com sells a 2D/3D motion analysis system using digital video and high speed cameras, and there appear to be a few other rudimentary programs. This has been applied to the UAS navigation context as shown in the F. Rafi et al. article "Autonomous Target Following by Unmanned Aerial Vehicles", which teaches an attempt to use it for automatic target tracking of a UAS. However, this application tracks a moving target in different directions but does not monitor airspace. The '607 patent to Wood also determines speed and motion vectors for surrounding objects.

Finally, with regard to any scenario-based avoidance capabilities, the '232 Bodin et al. patent (IBM) issued Jun. 5, 2007 shows a UAS control system that identifies obstacles in the path, and then decides on a particular avoidance algorithm. An array of avoidance algorithms are taught.

It would be greatly advantageous in light of this cluttered prior art background to consolidate hardware/software into a functional and compact UAS S&A system combining a wide field airborne imager capable of providing airspace imaging over a large field of view at high resolution and range of detection using a single camera, and a trajectory-based control system that is reliable and capable of autonomous or even semiautonomous operation to avoid collisions with other aircraft or with terrain objects.

SUMMARY OF THE INVENTION

Accordingly, it is an object of the present invention to provide a Unmanned Aircraft System (UAS) Sense and Avoid (S&A) system capable of airspace imaging over a large field of view at high resolution and range of detection using a single camera, and trajectory-based control for autonomous or semiautonomous operation to avoid collisions with other aircraft, airborne objects, or with terrain objects.

It is another object to provide a low-mass, volume and power system for effective, onboard, autonomous S&A capabilities as necessary to facilitate operations of small UASs (sUASs) in the NAS, so as not to substantially diminish the payload capacity of the sUAS.

It is another object to provide a UAS S&A system capable of airspace imaging over a large field of view at high resolution and range of detection using a single high-definition camera and fiber optic image transfer devices.

It is another object to provide a UAS S&A system capable of a full spherical field of view or any subset of full spherical. In this regard, for larger UAS the system could include more than one camera, but by using fiber optic image transfer devices the reduced mass, volume and power of our invention are still of substantial benefit.

It is another object of the invention that the fiber optic image transfer devices may be distributed in a variety of ways on the UAS, including arrangements that create a stereo view to improve the accuracy of range measurements of an aircraft or terrain obstacle.

It is another object of the invention that the sensors used may be of a variety of types including those operating in the visible, infrared or other parts of the electromagnetic spectrum, those operating over wide or narrow bands of the spectrum, those operating simultaneously in one or multiple bands of the spectrum, and sensors operating in single frame mode or in motion imagery (video) mode.

It is another object of the invention that the system can operate on manned aircraft.

It is another object of the invention that, along with performing the sense and avoid function, it can also be used to perform safer and more effective collaborative or formation flight activities.

It is another object of the invention that the system can operate on other types of unmanned systems such as Unmanned Ground Vehicles, and Unmanned Sea Vehicles.

It is another object of the invention to locate the camera in the interior of the vehicle so as to protect it from the exterior environment.

In accordance with the foregoing and other objects, the present invention is a Widefield Airspace Imaging and Monitoring System with wide field (preferably full spherical) airspace imaging and collision avoidance capabilities for safe, efficient, and effective operations. The invention includes a wide array imaging system, including a camera mounted within the vehicle, an array of collection lenses distributed throughout the vehicle, each viewing a complementary portion of the airspace around the vehicle, and individually attached to fiber optic image transfer devices, the other end of which are all connected to the camera body in such a way so as to project the image captured by each lens onto adjacent sections of the camera's sensor, thereby providing views in all directions to comprise a spherical view with a single camera. In addition, a processing system is connected to the wide array imaging system, and it includes an image interpolation software program for resolving a background image and for distinguishing objects that are not moving with the background image, and a collision target extraction software program for interfacing between the image interpolation software program and an existing UAS autopilot system for rule-based avoidance maneuver decision making based on objects that are found not to be moving with the background.

The system described herein provides effective, onboard, autonomous S&A capabilities as necessary to facilitate operations of UASs in the NAS, and will not substantially diminish the payload capacity of a sUAS. Indeed, the total weight of the system is approximately 1 pound.

BRIEF DESCRIPTION OF THE DRAWINGS

Other objects, features, and advantages of the present invention will become more apparent from the following detailed description of the preferred embodiments and certain modifications thereof when taken together with the accompanying drawings in which:

FIG. 5 illustrates a simplified diagram showing the coverage orientations according to another preferred embodiment of the invention in which six lenses 110, are positioned to comprise a forward-looking field of view to provide higher resolution image matching the standard recommended by ASTM to the FAA for S&A systems, with both redundancy and stereo imaging for improved range detection.

DETAILED DESCRIPTION OF THE PREFERRED EMBODIMENTS

The present invention is a Widefield Airspace Imaging and Monitoring (WAIM) system designed to provide UASs with full spherical airspace imaging and collision avoidance capabilities to enable safe, efficient, and effective operations.

Figure 1:
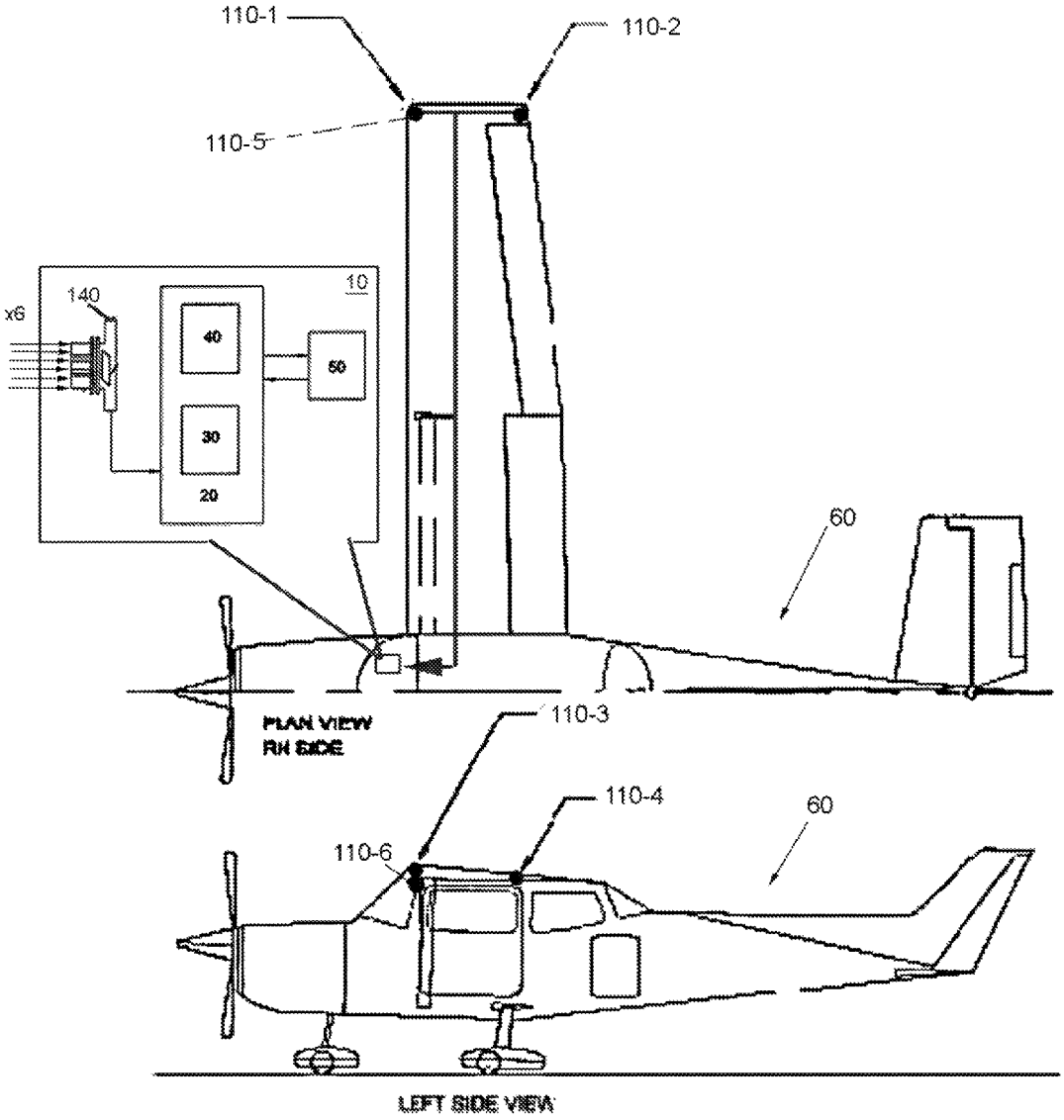
FIG. 1 is a perspective view of the WAIM system according to an exemplary embodiment of the invention.

FIG. 1 is a perspective view of the WAIM system according to an exemplary embodiment of the invention, configured for a small fixed wing aircraft, though other vehicle configurations are also contemplated, including fixed wing and rotary wing aircraft, among others. The present invention includes a wide array imaging system 10, including a single high definition camera 140 mounted within the cockpit of the vehicle 60, a distributed array of stationary collection lenses 110-1 . . . n mounted externally to the vehicle 60 in a spaced array, at varying positions, and at varying angular orientations, to provide unobstructed views in all directions, as well as spatial separation of the views. Each stationary collection lens 110-1 . . . n is individually attached to a fiber optic image transfer device 120, the other ends of which are all optically coupled to the camera body 140 in such a way so as to project the images captured by each lens in parallel directly onto adjacent sections of the camera sensor. In the presently preferred embodiment, a full unobstructed spherical field of view with spatial separation can be achieved with six (6) stationary collection lenses 110-1 . . . 6. Specifically, in the illustrated embodiment there are six 112 degree field of view lenses 110-1 . . . 6 mounted on the aircraft. These include a forward/right-hand/up lens 100-1 mounted on the leading upward distal tip of the right-side wing, an aft/right-hand/up lens 100-2 mounted on the aft upward distal tip of the right-side wing, a forward/right-hand/down lens 100-5 mounted on the leading downward distal tip of the right-side wing, a forward/left-hand/up lens 100-3 mounted on the leading upward distal tip of the left-side wing, an aft/left-hand/up lens 100-4 mounted on the aft upward distal tip of the left-side wing, and a forward/left-hand/down lens 100-6 mounted on the leading downward distal tip of the right-side wing. All six stationary collection lenses 110-1 . . . 6 are individually attached via fiber optic image transfer devices 120 to the camera body 140. The lenses 110-1 . . . 6 are oriented to collectively provide unobstructed views in all directions to comprise a spherical view. A variety of commercially available fiber optic image transfer devices 120 exist that will suffice. The camera 140 in the currently preferred embodiment weighs less than one pound and utilizes a 15 megapixel sensor. The spherical detection range of this currently preferred embodiment of the WAIM system is approximately 1 mile. In addition, a processing system 20 is connected to the wide array imaging system (as shown in the inset of FIG. 1), and it includes an image interpolation software program 30 for resolving a background image and for distinguishing objects that are not moving with the background image, and a collision target extraction software program 40 for interfacing between the image interpolation software program 30 and an existing UAS autopilot system 50 for rule-based avoidance maneuver decision making based on objects that are found not to be moving with the background.

As unidentified objects get closer to the UAS, the collision target extraction software program 40 decides when to command the UAS autopilot 50 to change direction, altitude and/or airspeed to avoid collision, and compiles and issues the appropriate command set.

Figure 2:
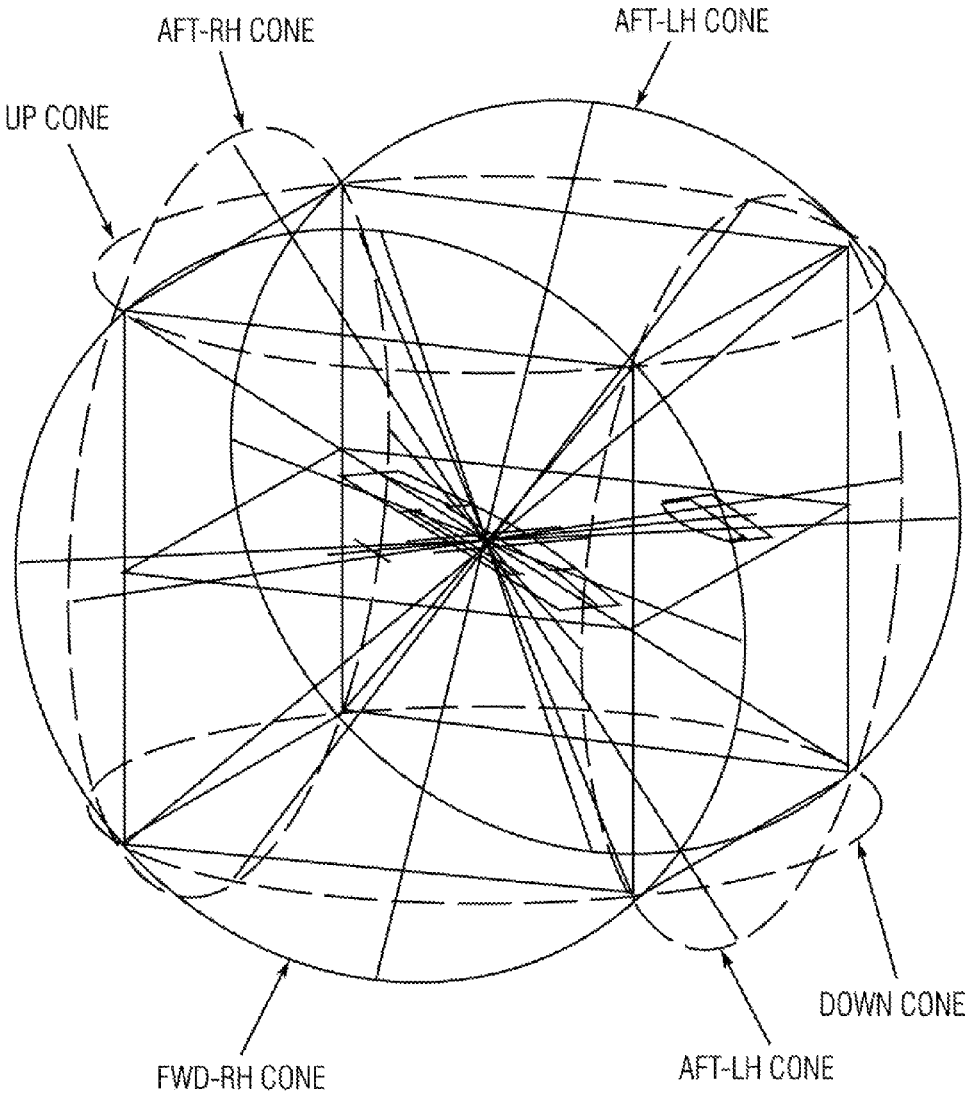
FIG. 2 is a standoff view illustrating how full 3D spherical coverage can be obtained with six lenses.

FIG. 2 is a standoff view illustrating how full 3D spherical coverage can be obtained with six lenses. The lenses will yield six overlapping fields of view or "sensor cones" including left and right upward cones, and left and right forward and downwardly-inclined cones. This hypothetical assumes placement of the lenses at a center point on the vehicle frame, and with each lens imaging a 112 degree field of view a full 3D spherical coverage is possible.

In practice, actual placement of the lenses will be near the extremities of the vehicle 60 frame to provide overlap of fields of view beyond some distance (approximately 500 ft depending on the vehicle details) without obstruction of any view by the vehicle.

Figure 3:
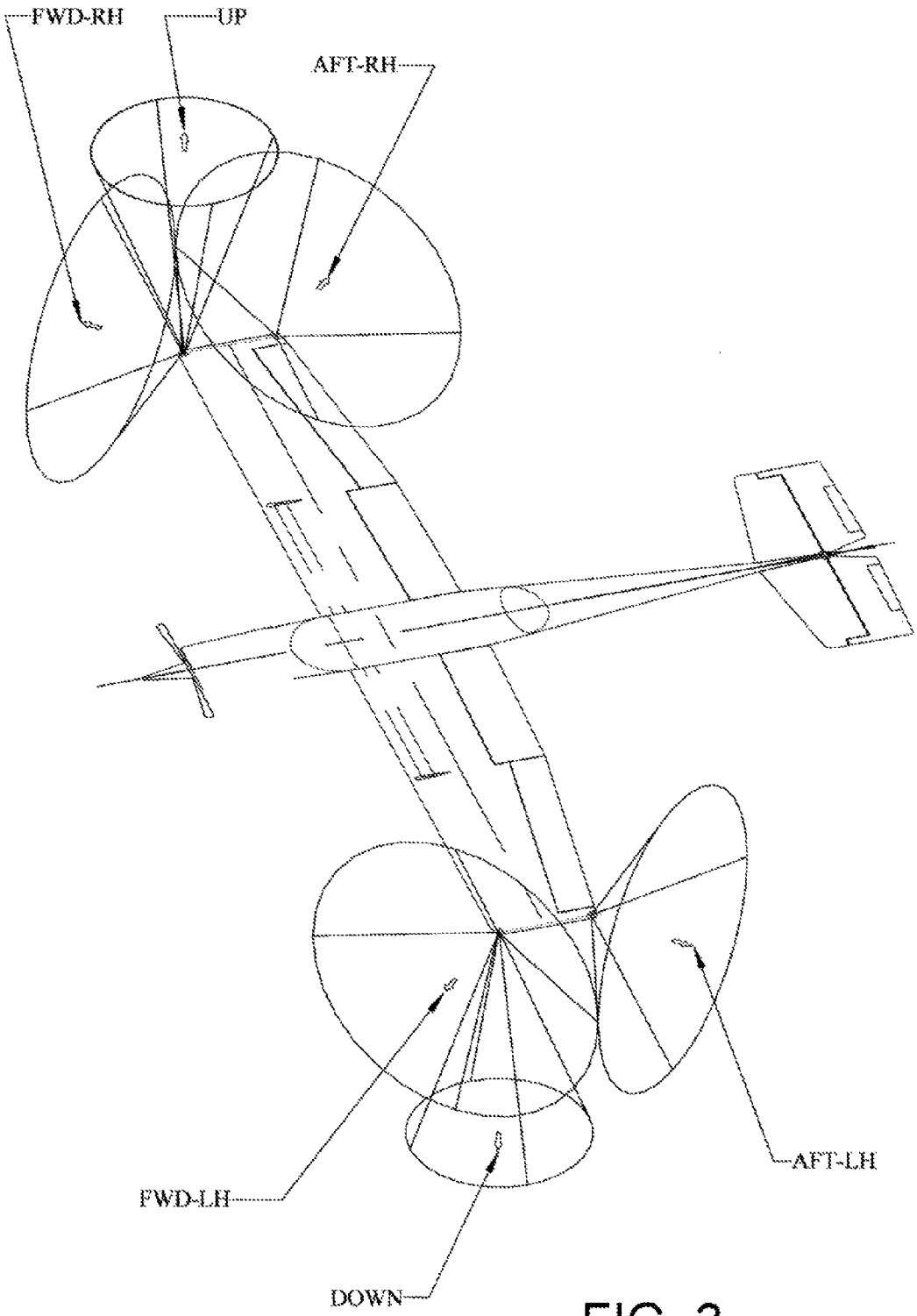
FIG. 3 is a standoff view of the invention showing how spherical coverage can be obtained according to the exemplary embodiment of FIG. 1.

Thus, FIG. 3 is a standoff view of the invention showing how spherical coverage can be obtained according to the exemplary embodiment of FIG. 1. The six stationary collection lenses 110-1 . . . 6 yield the six overlapping "sensor cones" including aft-RH, forward-RH, up-RH, aft-LH, forward-LH, and up-LH. Given that each collection lens 110-1 . . . 6 must image a conical angle of 109.5° with some overlap, a 112° field of view is presently preferred, and will provide overlapping fields of view beyond ~500 ft without obstruction of any view by the vehicle. One skilled in the art will understand that more or fewer lenses may be employed without departing from the scope and spirit of the invention.

Figure 4:
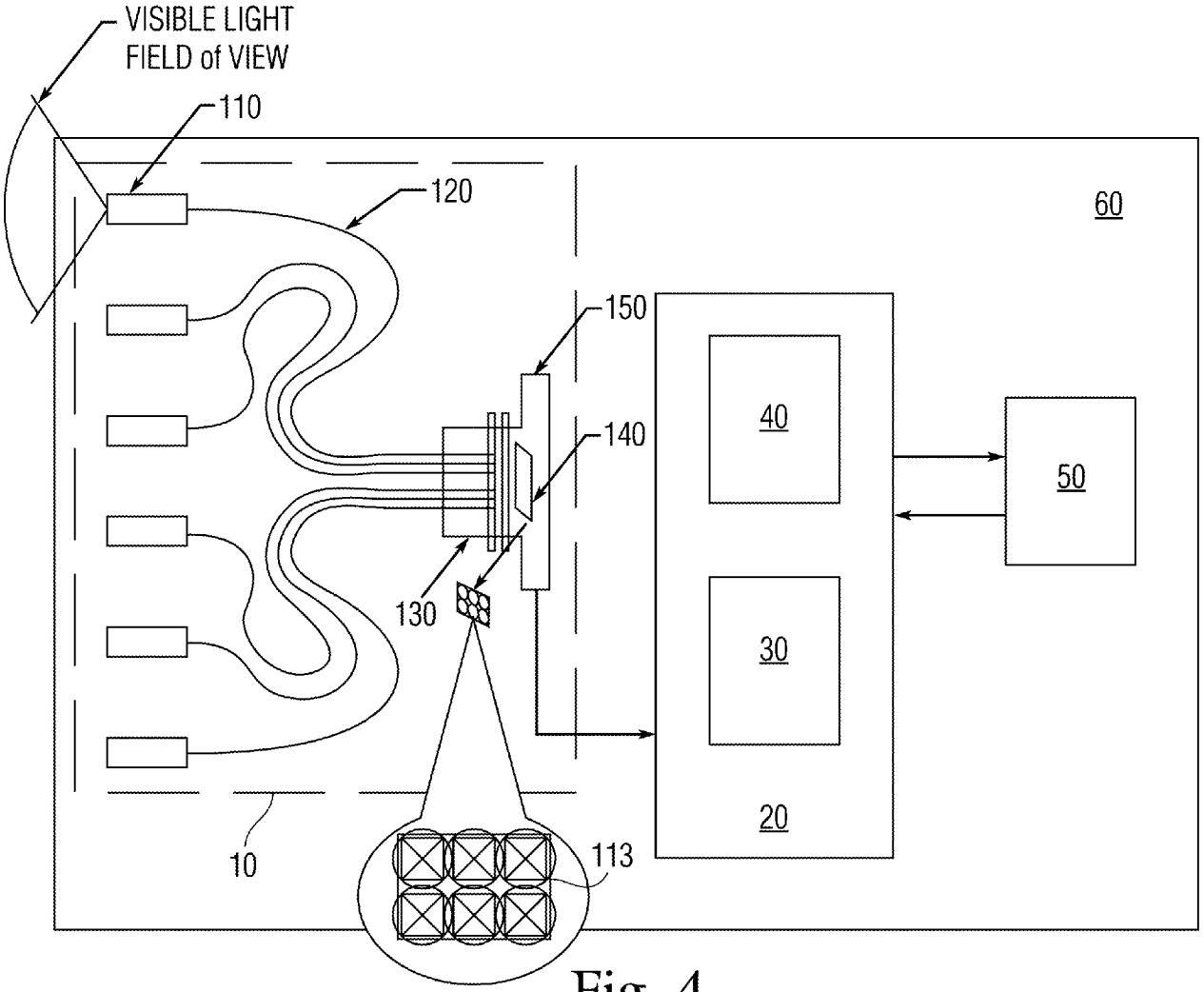
FIG. 4 is a schematic diagram of the optical imaging system 10, and processing system 20 including image interpolation software program 30 and collision target extraction software program 40.

FIG. 4 is a schematic diagram of the optical imaging system 10, and processing system 20 including image interpolation software program 30 and collision target extraction software program 40. The optical imaging system 10 includes a single camera 140 with high definition digital sensor 150 mounted within the vehicle 60 cockpit, the array of stationary collection lenses 110-1 . . . 6 mounted externally on the vehicle 60 to provide unobstructed views in all directions 110, each individually attached to fiber optic image transfer devices 120, the other ends of which are all connected to a mechanical mount 130, which in turn is connected to the camera body 140 in such a way so as to project the discrete images captured by each lens in parallel directly onto adjacent sections of an imaging sensor 150, which may be a conventional CMOS or CCD imaging chip, or an array of image sensors, located in a single camera body or on a PCB 140. A variety of commercially available fiber optic image transfer devices exist that will suffice. In the preferred embodiment the ends of the six fiber optic image transfer devices are rectangular in cross section (not circular), to match the rectangular geometry of the sensor 150 for higher efficiency of image transfer. If a single sensor is utilized as in the exemplary embodiment, the imaging sensor 150 can be approximately 4800×3250 pixels, or 15 million pixels. The mount 130 is positioned to resolve the discrete images directly onto the imaging sensor 150 within six defined areas, each approximately 2.5 million pixels. Since the six images include overlapping fields of view, the area of overlap may be resolved either optically or by software resident in the image interpolation software program 30 running in processing system 20. The inset 113 to FIG. 4 illustrates how this is done optically in the preferred embodiment. The circles show the entire image including overlap, and the smaller squares represent the images captured by the imaging sensor 150. Alternately, the camera may include a lens to resolve the discrete images including overlapping areas onto the imaging sensor 150 within six adjacent imaging areas, and the twice-captured area of overlap may be distinguished by the image interpolation software program 30 running in processing system 20, and the area of overlap accounted for by the software, and stitched together by the software. The spherical detection range of this currently preferred embodiment of the WAIM system is approximately 1 mile.

The foregoing provides a mosaic of narrow-field images that collectively make up the full wide (spherical) field view of the airspace surrounding the vehicle.

Given a wide field mosaic image, the mosaic image data is sent to the processor 20.

The processing system 20 is connected to the wide array imaging system 10, and it includes an image interpolation software program for resolving a background image and for distinguishing objects that are not moving with the background image 30, and a collision target extraction software program 40 for interfacing between the image interpolation software program and an existing UAS autopilot system 50 for rule-based avoidance maneuver decision making based on objects that are found not to be moving with the background.

In the currently preferred embodiment, the processor 20 is a field-programmable gate array (FPGA)-based miniature computer controller and includes an industry standard Gigabit Ethernet interface to the camera 140 by which it controls the triggering, frame rate, exposure time, and windowing, and other camera parameters. The processor 20 also runs interpolation software program 30. Program 30 includes automated feature detection software to detect movement of objects and features within the field of view. It does this by analyzing sequential image frames, identifying image features moving at a constant rate between frames (indicating a background feature), and then looking for features (objects) moving at a different speed within the defined background (indicating moving objects and possible aircraft). The interpolation software program 30 interfaces with the navigation control software program 40. If the navigation control software program 40 identifies a moving object (not moving with the background) approaching the vehicle 60, it applies a rule-based decision engine that sends a command to the UAS autopilot system 50 to change direction, speed and/or altitude to avoid collision.

FIG. 5 illustrates a simplified diagram showing the coverage orientations according to another preferred embodiment of the invention in which six lenses 110, each with a 64 degree field of view, are oriented in a forward looking orientation to comprise a total 220 by 30 degree field of view. This provides image matching the standard recommended by ASTM to the FAA for S&A systems, and also provides a 64 degree stereo image in the forward direction to provide redundancy of coverage in the forward direction and to improve the accuracy of range measurements of an aircraft or terrain obstacle using standard photogrammetric techniques to improve target distance measurement accuracy. The detection range of this preferred embodiment of the WAIM system is approximately 3 miles.

It should now be apparent that the foregoing embodiment consolidates hardware and software to provide a functional wide field airspace imaging and collision avoidance system for UASs that is reliable and capable of autonomous or even semiautonomous operation. The system described above provides effective, onboard, autonomous S&A capabilities as necessary to facilitate operations of UASs in the NAS, and does not substantially diminish the payload capacity of an sUAS (the total weight of the system is approximately 1 pound).

Therefore, having now fully set forth the preferred embodiment and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

What is claimed is:

1. A widefield airspace imaging and monitoring system for imaging the airspace around an unmanned aerial vehicle having a right-side wing, a left-side wing, and an autopilot system, comprising:

a digital camera mounted within said vehicle, said camera having a digital image sensor;

a plurality of stationary collection lenses mounted in a distributed array about the vehicle and oriented in a plurality of angular orientations, said plurality of stationary collection lenses further consisting of six (6) collection lenses, a first lens being mounted on a leading upward distal tip of the right-side wing of said vehicle, a second lens mounted on an aft upward distal tip of the right-side wing of said vehicle, a third lens mounted on a leading downward distal tip of the right-side wing of said vehicle, a fourth lens mounted on a leading upward distal tip of a left-side wing of said vehicle, a fifth lens mounted on an aft upward distal tip of a left-side wing of said vehicle, and a sixth lens mounted on a leading downward distal tip of a left-side wing of said vehicle, each of said plurality stationary collection lenses having a pre-determined 112 degree field of view, said angular orientations being calculated so that the field of view of each of said plurality stationary collection lenses overlaps with the field of view of another of said plurality stationary collection lenses; and a plurality of optical fiber image transfer devices each connected at one end to a corresponding one of said plurality of stationary collection lenses;

a mechanical mount connected to the other end of said plurality of optical fibers in such a way so as to project the images captured by each of said plurality stationary collection lenses onto adjacent defined subareas of said digital camera image sensor, thereby forming a mosaic of narrow-field images resolved by said camera into a wide field image of the airspace surrounding the vehicle; and a processor and memory for storing software and image data comprising a plurality of sequential frames of said wide field image of the airspace surrounding the vehicle; and software comprising computer instructions stored on non-transitory memory for carrying out the steps of, resolving a background image moving at a constant rate within said image data, distinguishing an object within said image data that is not moving with the background image, determining a rate at which said object changes its position, determining that an avoidance measure is needed to avoid colliding with said object, and communicating to said autopilot that said avoidance measure is needed.

2. The widefield airspace imaging and monitoring system for imaging the airspace around a vehicle according to claim 1, wherein said software for carrying out the step of deciding when avoidance measures are needed further comprises a collision target extraction software module for interfacing between the image interpolation software module and an existing UAS autopilot system for rule-based avoidance maneuver decision making based on said determined rate at which said object changes its position.

3. The widefield airspace imaging and monitoring system for imaging the airspace around a vehicle according to claim 1, wherein said mosaic of narrow-field images are resolved by said camera into a wide field image of a full 360 degree view of said airspace around the vehicle.

4. The widefield airspace imaging and monitoring system for imaging the airspace around a vehicle according to claim 1, wherein the ends of said plurality of optical fibers connected to said mechanical mount are rectangular in cross section.

5. The widefield airspace imaging and monitoring system for imaging the airspace around a vehicle according to claim 1, wherein said processor is a field-programmable gate array (FPGA)-based processor.

6. The widefield airspace imaging and monitoring system for imaging the airspace around a vehicle according to claim 1, wherein said image interpolation software module distinguishes objects that are not moving within a background image by analyzing sequential image frames, identifying image features moving at a constant rate between sequential frames, and then identifying features moving at a different velocities than said constant rate within the defined background.

7. The widefield airspace imaging and monitoring system for imaging the airspace around a vehicle according to claim 1, wherein said image interpolation software module sends a command to the UAS autopilot system for rule-based avoidance maneuver decision making.

8. The widefield airspace imaging and monitoring system for imaging the airspace around a vehicle according to claim 7, wherein said command may be any one from among the group consisting of change direction, change speed, and change altitude.

9. A widefield airspace imaging and monitoring system for imaging the airspace around an unmanned aerial vehicle having a right-side wing, a left-side wing, and an autopilot system, comprising:

a digital camera mounted within said vehicle, said camera having a digital image sensor;

a plurality of stationary collection lenses mounted in a distributed array about the vehicle and oriented in a plurality of angular orientations, said plurality of stationary collection lenses further consisting of six (6) stationary collection lenses including a first lens mounted on a leading upward distal tip of the right-side wing of said vehicle, a second lens mounted on an aft upward distal tip of the right-side wing of said vehicle, a third lens mounted on a leading downward distal tip of the rightside wing of said vehicle, a fourth lens mounted on a leading upward distal tip of a leftside wing of said vehicle, a fifth lens mounted on an aft upward distal tip of a left-side wing of said vehicle, and a sixth lens mounted on a leading downward distal tip of a left-side wing of said vehicle, each of said plurality stationary collection lenses having a pre-determined 64 degree field of view, said angular orientations being calculated so that the field of view of each of said plurality stationary collection lenses overlaps with the field of view of another of said plurality stationary collection lenses;

a plurality of optical fiber image transfer devices each connected at one end to a corresponding one of said plurality of stationary stationery collection lenses;

a mechanical mount connected to the other end of said plurality of optical fibers in such a way so as to project the images captured by each of said plurality of collection lenses onto adjacent defined subareas of said digital camera image sensor, thereby forming a mosaic of narrow-field images resolved by said camera into a wide field image of the airspace surrounding the vehicle;

a processor and memory for storing software and image data comprising a plurality of sequential frames of said wide field image of the airspace surrounding the vehicle; and software comprising computer instructions stored on non-transitory memory for carrying out the steps of, resolving a background image within said image data, distinguishing an object within said image data that is not moving with the background image, determining a rate at which said object changes its position, deciding that an avoidance measure is needed to avoid colliding with said object based on said change in position, and communicating to said autopilot that said avoidance measure is needed.

10. The widefield airspace imaging and monitoring system for imaging the airspace around a vehicle according to claim 9, wherein said mosaic of narrow-field images are resolved by said camera into a wide field image of a 220 by 30 degree view of said airspace around the vehicle.

11. The widefield airspace imaging and monitoring system for imaging the airspace around a vehicle according to claim 9, wherein said mechanical mount comprises a mounting block positioned to resolve the discrete images from each of said six (6) stationary collection lenses directly onto the imaging sensor of said camera.

12. The widefield airspace imaging and monitoring system for imaging the airspace around a vehicle according to claim 11, wherein said digital camera imaging sensor comprises a 15 million pixel imaging sensor.

13. The widefield airspace imaging and monitoring system for imaging the airspace around a vehicle according to claim 12, wherein said mechanical mount comprises a mounting block positioned to resolve the discrete images from each of said six (6) stationary collection lenses into six defined 2.5 million pixel mosaics of said image sensor.

14. An airborne imaging system for monitoring airspace by a UAS vehicle having a right-side wing, a left-side wing, and an autopilot system, comprising:

a wide array imaging system, including, a single high definition camera mounted within the vehicle, an array of collection lenses distributed throughout the vehicle to provide a wide field of view from a plurality of narrower overlapping fields of view, said array of collection lenses further comprising six collection lenses, including three said collection lenses mounted at a tip of the right-side wing of said vehicle, and three said collection lenses mounted at a tip of the left-side wing of said vehicle, each of said plurality of stationary collection lenses having a pre-determined field of view equal to one of 64 degrees or 112 degrees and being mounted at an angular orientation calculated so that the field of view of each of said plurality stationary collection lenses overlaps with the field of view of another of said plurality of said stationary collection lenses;

a plurality of optical fiber image transfer devices each coupled to one of said collection lenses for conveying the discrete optical images there from, a mechanical mount coupled to one end of said plurality of optical fibers for multiplexing the several images there from onto a single imaging sensor, said imaging sensor having a plurality of predefined image areas each corresponding to one of said discrete optical images and collectively forming a mosaic wide field airspace image; and a processing system connected to said wide array imaging system, said processing system including an image interpolation software program comprising computer instructions stored on non-transitory memory for carrying out the steps of, resolving a background image within said wide field airspace image, distinguishing an object that is not moving with the background image, deciding that an avoidance measure is needed to avoid colliding with said object, and communicating to said autopilot that said avoidance measures are needed.

15. The airborne imaging system for monitoring airspace according to claim 14, wherein said software further comprises a navigation control software program for interfacing between the image interpolation software program and an existing UAS autopilot system for performing said step of deciding that an avoidance measure is needed by rule-based avoidance maneuver decision making.

16. The airborne imaging system for monitoring airspace according to claim 14, wherein each of said plurality of stationary collection lenses has a pre-determined field of view equal to 64 degrees, and said multiplexing of the several images onto said single imaging sensor mosaic are resolved into a wide field image of a full 360 degree spherical view of said airspace around the vehicle.

17. The airborne imaging system for monitoring airspace according to claim 14, wherein each of said plurality of stationary collection lenses has a pre-determined field of view equal to 112 degrees, and said multiplexing of the several images onto said single imaging sensor mosaic are resolved into a wide field image of a subset of a 360 degree view of said airspace around the vehicle.

18. The airborne imaging system for monitoring airspace according to claim 14, wherein said camera is one of a frame camera for acquiring a sequence of individual images or a video camera for acquiring images at a high frame rate.

19. The airborne imaging system for monitoring airspace according to claim 18, wherein said camera acquires images in any one or more of the following segments of the light spectrum, comprising color, near infrared, short wave infrared, medium wave infrared or long wave infrared segments of the spectrum.

* * * * *